US011320179B2

(12) United States Patent
Prohaska

(10) Patent No.: US 11,320,179 B2
(45) Date of Patent: May 3, 2022

(54) FLUID OR GAS COOLING AND/OR CONDENSING APPARATUS, SYSTEM AND METHOD

(71) Applicant: Randy Prohaska, San Jose, CA (US)

(72) Inventor: Randy Prohaska, San Jose, CA (US)

( * ) Notice: Subject to any disclaimer, the term of this patent is extended or adjusted under 35 U.S.C. 154(b) by 50 days.

(21) Appl. No.: 16/681,383

(22) Filed: Nov. 12, 2019

(65) Prior Publication Data

US 2021/0095900 A1 Apr. 1, 2021

Related U.S. Application Data

(63) Continuation-in-part of application No. 16/584,468, filed on Sep. 26, 2019.

(51) Int. Cl.

| | |
|---|---|
| ***F25B 21/02*** | (2006.01) |
| ***F25D 17/02*** | (2006.01) |
| ***F25B 39/04*** | (2006.01) |

(52) U.S. Cl.

CPC ..... *F25B 21/02* (2013.01); *F25B 39/04* (2013.01); *F25D 17/02* (2013.01)

(58) Field of Classification Search

CPC ..... F25B 21/02; F25B 39/04; F25B 45/00; F25B 2345/002; F25D 17/02

See application file for complete search history.

(56) References Cited

U.S. PATENT DOCUMENTS

| | | | | |
|---|---|---|---|---|
| 3,226,602 | A | 12/1965 | Elfving | |
| 4,311,017 | A | 1/1982 | Reed | |
| 5,007,242 | A | 4/1991 | Nakayama | |
| 6,173,575 | B1 | 1/2001 | Hall | |
| 7,272,936 | B2 | 9/2007 | Feher | |
| 7,752,852 | B2 * | 7/2010 | Akei | H01L 35/00 62/115 |
| 9,395,109 | B2 | 1/2016 | Berger | |
| 9,618,240 | B2 | 4/2017 | Prohaska | |
| 2003/0215341 | A1 | 11/2003 | Maiefski | |
| 2004/0194496 | A1 | 10/2004 | Gleason | |
| 2006/0000221 | A1 * | 1/2006 | Culp | F25B 21/02 62/3.6 |
| 2008/0247441 | A1 | 10/2008 | Salvetti | |
| 2009/0081981 | A1 | 3/2009 | Scardino | |
| 2011/0083446 | A1 | 4/2011 | Pinet | |
| 2014/0230477 | A1 * | 8/2014 | Furui | F24F 5/00 62/238.6 |

* cited by examiner

*Primary Examiner* — Ana M Vazquez
(74) *Attorney, Agent, or Firm* — Scherrer Patent & Trademark Law, P.C.; Stephen T. Scherrer; Monique A. Morneault

(57) ABSTRACT

A fluid or gas cooling and/or condensing apparatus, system and method provides a cooling apparatus for cooling and condensing material, such as, for example, refrigerant from air conditioners, refrigerators, and other like mechanical cooling devices for collecting the same, and/or other gases and/or fluids, such as wine, for example.

11 Claims, 8 Drawing Sheets

FLUID OR GAS COOLING AND/OR CONDENSING APPARATUS, SYSTEM AND METHOD

CROSS-REFERENCE TO RELATED APPLICATIONS

The present invention claims priority to U.S. patent application Ser. No. 16/584,468 titled, "Fluid or Gas Cooling and/or Condensing Apparatus, System and Method," filed Sep. 26, 2019, which is incorporate by reference herein in its entirety.

TECHNICAL FIELD

The present invention relates to a fluid or gas cooling and/or condensing apparatus, system and method. Specifically, the present invention provides a cooling apparatus for cooling and condensing material, such as, for example, refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein a cooling fluid, such as water, for example, is sent through the coil, and heat is removed therefrom and transferred to the heat plate. The cooled fluid is then circulated through a condenser coil within a cooling cylinder to condense the same for easy collection within a tank or other receptacle. Other gases and/or fluids may be condensed and/or chilled in a similar fashion, such as wine, for example.

BACKGROUND

It is, of course, generally known to use mechanical devices for cooling, such as air conditioners and refrigerators, for example. Specifically, an air conditioner or a refrigerator uses a system to blow air over chilled coils, removing heat from the air and chilling the air. The chilled air then moves into an enclosed space to chill the enclosed space. In an air conditioner, the chilled air is forced into a building, such as a house or other structure. In a refrigerator, the chilled air is forced into a thermally sealed, insulated and enclosed space for keeping foods chilled and fresh. Of course, refrigerants are known for use in many other applications as apparent to one of ordinary skill in the art.

Refrigeration systems generally comprise a refrigerant, commonly known as "Freon," which, through an enclosed cycle, moves repeatedly through a series of compression and expansion. The refrigerant is a chemical that is compressed to form a liquid and sent through coils, where heat generated from the compression is transferred to air flowing over the coils and blown off to cool down the compressed refrigerant. The refrigerant is then passed through an expansion valve and into cooling coils, where the compressed refrigerant experiences a pressure drop, changing from the compressed liquid to a gas through cooling coils. Heat is removed from air as the air is blown over the cooling coils, thereby chilling the air, and the chilled air is then moved into the enclosed space for cooling the enclosed space, whether into a building or a refrigerator. The refrigerant is then compressed in a compressor into a liquid and the cycle repeats itself.

Refrigerant contained within the air conditioner or refrigerator is typically utilized over and over again in a repeating cycle of compression and expansion. However, in many cases, leaks may develop in the systems, requiring additions to or even replacement of the refrigerant. Moreover, the common Freon utilized in air conditioners, known as R22, is known to cause problems in the environment, namely damage to the ozone layer of earth. Therefore, the more environmentally-friendly R410A is typically utilized as a replacement. If air conditioners or refrigerators require additions or repair, the R22 is typically removed and the R410A is typically added, thereby replacing the refrigerant.

Replacing the refrigerant in these systems is often difficult. Typically, refrigerant is removed from the air conditioners or refrigerators in the evaporated or gaseous form. However, it is often difficult to collect the refrigerant. Considering that the refrigerant typically removed from air conditioners and/or refrigerators is often the environmentally-damaging R22 Freon, it is very important that the refrigerant is collected and not released into the atmosphere where it can cause environmental damage. A need exists, therefore, for an apparatus, system and method for collecting refrigerant removed from an air conditioner or a refrigerator. Specifically, a need exists for an apparatus, system and method for easily and efficiently collecting refrigerant without releasing the same to the atmosphere.

Since refrigerant is typically removed as a gas from an air conditioner or a refrigerator, it must be collected in tanks. However, it is often difficult to fill a tank to capacity with hot gas, as the pressure of a tank rapidly increases as gaseous refrigerant is added. In other words, a tank can be filled with relatively little gaseous refrigerant before the tank is filled and will not accept further refrigerant. Oftentimes, one who removes and collects the refrigerant must replace tanks during the collection process. As tanks are moved and replaced, the potential for accidental release of the refrigerant increases. A need, therefore, exists for an apparatus, system and method for collecting refrigerant from an air conditioner and/or refrigerator that allows a tank to collect relatively more refrigerant than typical methods. Moreover, a need exists for an apparatus, system and method that reduce the potential of accidental release of refrigerant into the atmosphere.

Common techniques for collecting gaseous refrigerant typically involve cooling the refrigerant thereby reducing the volume of the same or even condensing the same prior to collection. Specifically, it is common to utilize an ice chest and a pipe through the ice chest that carries the gaseous refrigerant. However, it is often difficult to utilize the ice chest, as a relatively large, bulky space to contain a large amount of ice must be utilized. The ice melts, especially on hot days, which may cause a mess, especially if the chest develops a leak. Moreover, it may simply be difficult to obtain the required quantity of ice to prepare the ice chest for cooling the refrigerant. Once melted, a further supply of ice must be utilized to capture and collect additional refrigerant. A need, therefore, exists for an apparatus, system and method for collecting refrigerant without requiring use of an ice chest. Further, a need exists for an apparatus, system and method for cooling refrigerant that is relatively clean, easy to operate, quick to set-up and utilize without mess.

SUMMARY OF THE INVENTION

The present invention relates to a fluid or gas cooling and/or condensing apparatus, system and method. Specifically, the present invention provides a cooling apparatus for cooling and condensing material, such as, for example, refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein a cooling fluid, such as water, for example, is sent through the coil, and heat is removed therefrom and transferred to the heat plate. The cooled fluid is then circulated through a condenser coil within a cooling cylinder to condense the same for easy collection within a tank or other receptacle. Other gases and/or fluids may be condensed and/or chilled in a similar fashion, such as wine, for example. To this end, in an embodiment of the present invention, an apparatus for cooling a material is provided. The apparatus comprising: a thermoelectric cooler comprising a cold plate, a heat plate and a thermoelectric material between the cold plate and the heat plate for cooling the cold plate and heating the heat plate when voltage is applied across the thermoelectric material; a first cooling coil adjacent the cold plate; a cooling chamber having a first inlet and a first outlet and a second cooling coil disposed between the first inlet and the first outlet wherein a cooling fluid is sent through the first cooling coil to be cooled by the cold plate and thereafter to the second cooling coil within the cooling chamber, wherein the cooling chamber further comprises a second inlet and a second outlet, and configured to allow a material to be cooled to traverse through the second inlet, the chamber and the second outlet to be chilled by the second coiling coil.

In an embodiment, the apparatus further comprises: a pump for circulating the cooling fluid through the first cooling coil and the second cooling coil.

In an embodiment, the material is selected from the group consisting of a gaseous material and a liquid material.

In an embodiment, the material is a refrigerant.

In an embodiment, the material is wine.

In an embodiment, the apparatus further comprises: a fan disposed adjacent the hot plate for cooling the hot plate.

In an embodiment, the fan is disposed within a vented housing, and further wherein an airflow is pulled in the vented housing by the fan, propelled towards the heat plate, and subsequently pushed out of the vented housing.

In an embodiment, the first cooling coil is a twelve-pass coil.

In an alternate embodiment of the present invention, a system for cooling a material is provided. The system comprises: a cooling apparatus comprising a thermoelectric cooler comprising a cold plate, a heat plate and a thermoelectric material between the cold plate and the heat plate for cooling the cold plate and heating the heat plate when voltage is applied across the thermoelectric material; a first cooling coil adjacent the cold plate; a cooling chamber having a first inlet and a first outlet and a second cooling coil disposed between the first inlet and the first outlet and a second inlet and a second outlet; a cooling fluid circulating through the first cooling coil and cooled by the cold plate, the cooling fluid thereafter circulated to the second cooling coil within the cooling chamber; and a material within the cooling chamber chilled by the cooling fluid circulating within the second cooling coil.

In an embodiment, the material is refrigerant

In an embodiment, the system further comprises: a refrigeration unit having refrigerant therein, wherein the refrigeration unit comprises refrigerant, the refrigeration unit comprising an outlet configured to send the refrigerant to the second inlet in the cooling chamber to form chilled refrigerant within the cooling chamber; and a collection tank comprising an inlet configured to receive the chilled refrigerant from the second outlet of the cooling chamber.

In an embodiment, the system further comprises: a refrigerant reclaimer configured to move the refrigerant from the refrigeration unit to the first inlet of the cooling chamber.

In an embodiment, the material is wine.

In an embodiment, the system further comprises: a pump configured to circulate the cooling fluid through the first cooling coil and the second cooling coil.

In yet another alternate embodiment of the present invention, a method of cooling a material is provided. The method comprises the steps of: providing a cooling apparatus comprising a thermoelectric cooler comprising a cold plate, a heat plate and a thermoelectric material between the cold plate and the heat plate for cooling the cold plate and heating the heat plate when voltage is applied across the thermoelectric material; a first cooling coil adjacent the cold plate; a cooling chamber having a first inlet and a first outlet and a second cooling coil disposed between the first inlet and the first outlet and a second inlet and a second outlet; moving a cooling fluid through the first cooling coil and cooled by the cold plate; moving the cooling fluid from the first cooling coil to the second cooling coil within the cooling chamber; disposing a material within the cooling chamber; and chilling the material within the cooling chamber via heat exchange with the cooling fluid moving within the second cooling coil.

In an embodiment, the cooling fluid moves through the first cooling coil and the second cooling coil via a pump.

In an embodiment, the cooling fluid is circulating from the second cooling coil back to the first cooling coil via a recirculation pump.

In an embodiment, the material is selected from the group consisting of refrigerant and wine.

In an embodiment, the method further comprises the steps of: providing a refrigeration unit having refrigerant therein, wherein the refrigeration unit comprises refrigerant, the refrigeration unit comprising an outlet; providing a collection tank comprising an inlet; moving the refrigerant from the refrigeration unit into the cooling chamber to form chilled refrigerant; and moving the chilled refrigerant from the cooling chamber to the collection tank.

In an embodiment, the method further comprises the steps of: moving wine into the cooling chamber to form chilled wine; and moving the chilled wine out of the cooling chamber.

It is, therefore, an advantage and objective of the present invention to provide an apparatus, system and method for collecting refrigerant removed from an air conditioner or a refrigerator.

Specifically, it is an advantage and objective of the present invention to provide an apparatus, system and method for easily and efficiently collecting refrigerant without releasing the same to the atmosphere.

In addition, it is an advantage and objective of the present invention to provide an apparatus, system and method for collecting refrigerant from an air conditioner and/or refrigerator that allows a tank to collect relatively more refrigerant than typical methods.

Moreover, it is an advantage and objective of the present invention to provide an apparatus, system and method that reduce the potential of accidental release of refrigerant into the atmosphere.

Further, it is an advantage and objective of the present invention to provide an apparatus, system and method for collecting refrigerant without requiring use of an ice chest.

Still further, it is an advantage and objective of the present invention to provide an apparatus, system and method for cooling refrigerant that is relatively clean, easy to operate, quick to set-up and utilize without mess.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

Figure 1:
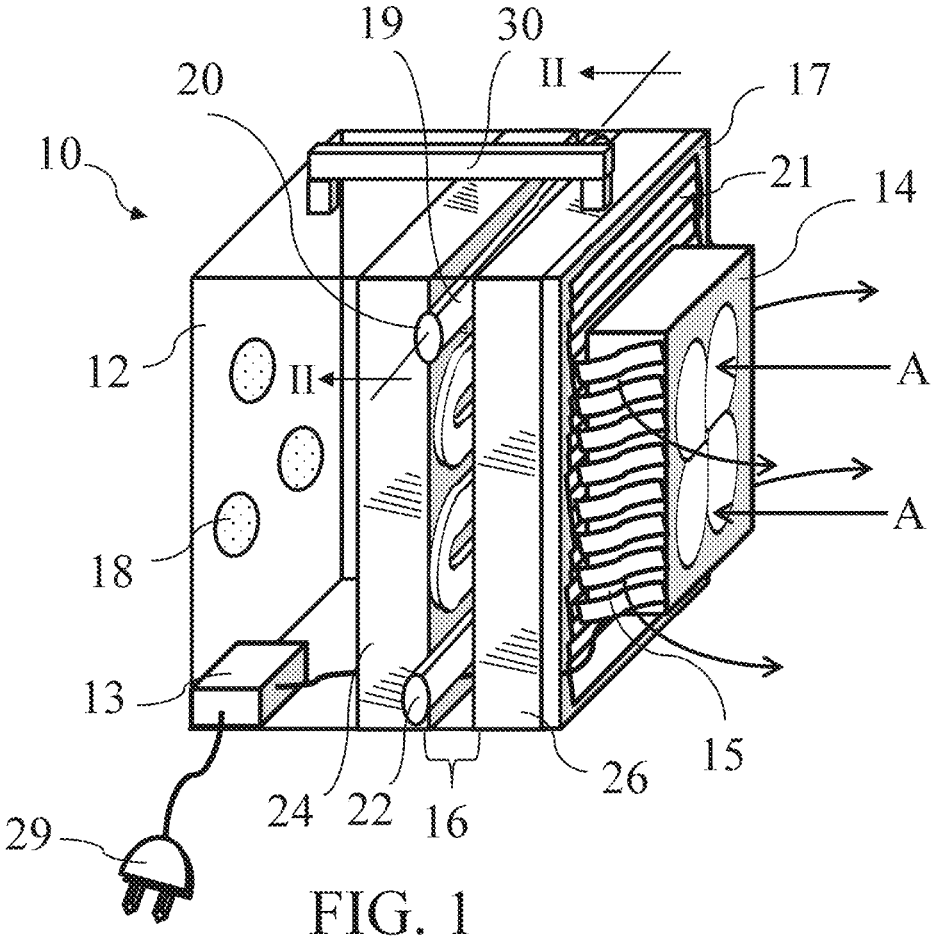
FIG. 1 illustrates a perspective view of a cooling apparatus in an embodiment of the present invention.

The present invention relates to a fluid or gas cooling and/or condensing apparatus, system and method. Specifically, the present invention provides a cooling apparatus for cooling and condensing material, such as, for example, refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein a cooling fluid, such as water, for example, is sent through the coil, and heat is removed therefrom and transferred to the heat plate. The cooled fluid is then circulated through a condenser coil within a cooling cylinder to condense the same for easy collection within a tank or other receptacle. Other gases and/or fluids may be condensed and/or chilled in a similar fashion, such as wine, for example. Now referring to the figures, wherein like numerals refer to like parts, FIG. 1 illustrates a cooling apparatus 10 for cooling and/or condensing refrigerant or other fluids. Specifically, the apparatus 10 comprises a housing 12 containing a fan 14, a plurality of fan vents 15, a cold plate 16, a heat plate 17, and vent holes 18 for venting heated air generated from an ac/dc converter 13 or other ambient heated air from the apparatus 10. The cold plate 16, the heat plate 17, and the ac/dc converter may act together to form a thermoelectric cooler, otherwise known as a "Peltier cooler". Specifically, the Peltier effect may be created when the cold plate 16, the heat plate 17, and the ac/dc converter act together. The Peltier effect refers to the generation or removal of heat created when a voltage is applied across two different materials, typically ceramic semi-conductors, or other conductive material known to one skilled in the art. When voltage is applied across the materials, a temperature differential is created, creating a cooled region (the cold plate 16) and a heated region (the heat plate 17). The cold plate 16 may be utilized to remove heat from another material, as described below.

In a preferred embodiment, the ac/dc converter may apply voltage between the cold plate 16 and the heat plate 17 through the thermoelectric cooler. Additionally, the fan 14 may be positioned adjacent the heat plate 17 and directed to blow thereon in order to cool the heat plate 17, thereby removing heat from the system. The heat plate 17 may additionally have one or more heat sinks 21 thereon in order to dissipate heat faster and efficiently. An airflow A may therefore be created to blow onto the heat plate 17. The airflow A may then traverse outwardly through the plurality of fan vents 15, as shown in FIG. 1, effectively cooling down the heat plate 17. Subsequently, additional heat may then be removed from the cold plate 16 and transferred to the heat plate 17, as previously discussed, and the heat plate 17 may be cooled thereafter. This process may continuously repeat.

Specifically, the cold plate 16 may contain a coil 19 having an inlet 20 and an outlet 22, whereby refrigerant may be added to the coil 19 through the inlet 20 and the refrigerant may further be expelled therefrom through the outlet 22. The coil 19 may be made of a thermally conducting metal, such as, for example, copper, and may wind through the cold plate 16 to provide a large amount of surface area for exchanging heat between the refrigerant flowing therethrough and the heat flow caused by the Peltier effect. The coil 19 may be sandwiched or other embedded within a first layer 24 of a combination of high surface area fins made from a thermally conductive material, such as metal, and thermal insulation, and a second layer 26 of high surface area fins made from a thermally conductive material, such as metal, and thermal insulation. The heat flow caused by the Peltier effect may be increased by sandwiching the coil 19 within the first layer 24 and the second layer 26.

Figure 2:
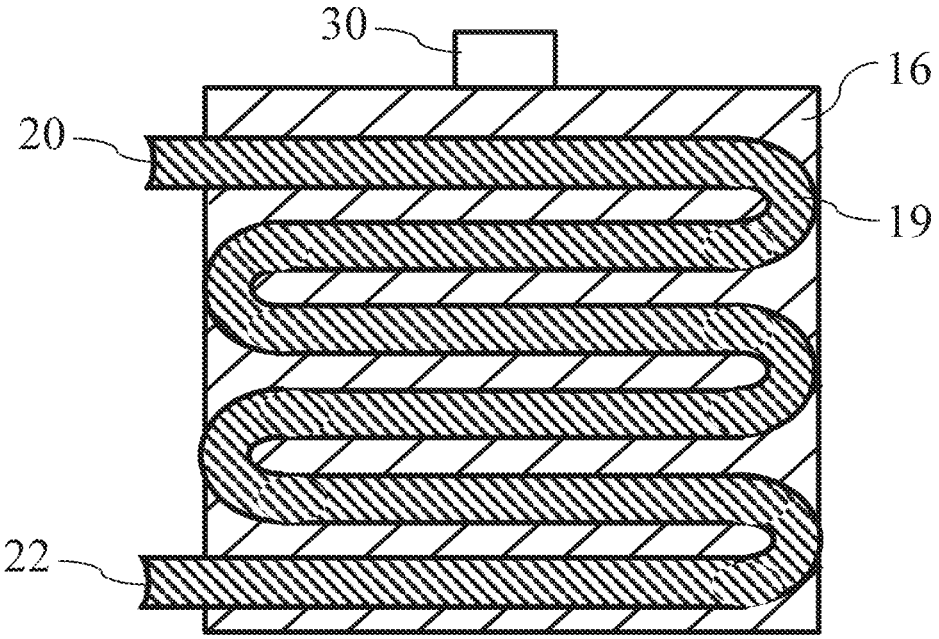
FIG. 2 illustrates a cross-sectional view along line II-II of a cooling apparatus in an embodiment of the present invention.

It should be noted that the coil should be of sufficient length providing sufficient surface area for the requisite heat exchange. For example, as illustrated in FIGS. 1 and 2, a cross-sectional view of FIG. 1 along line II-II, the coil may be a six-pass coil, providing significant length and, therefore surface area for the heat exchange. However, any length of coil may be utilized as necessary to effect the heat exchange, and the present invention should not be limited as described herein.

Figure 3:
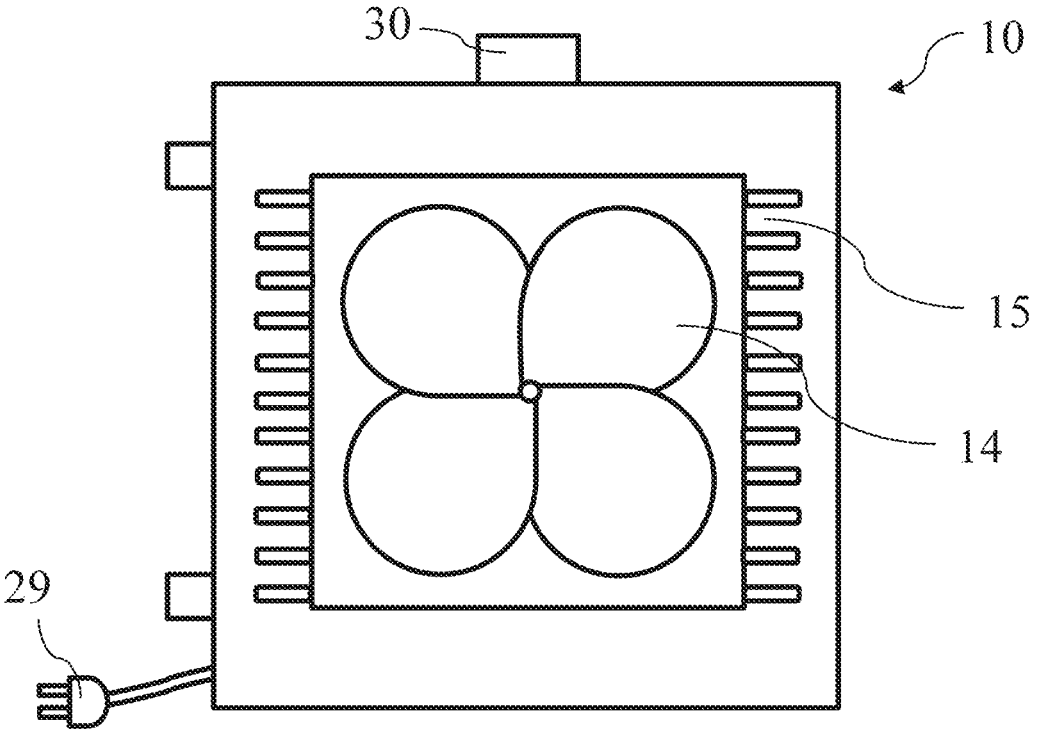
FIG. 3 illustrates a side view of a cooling apparatus in an embodiment of the present invention.
Figure 4:
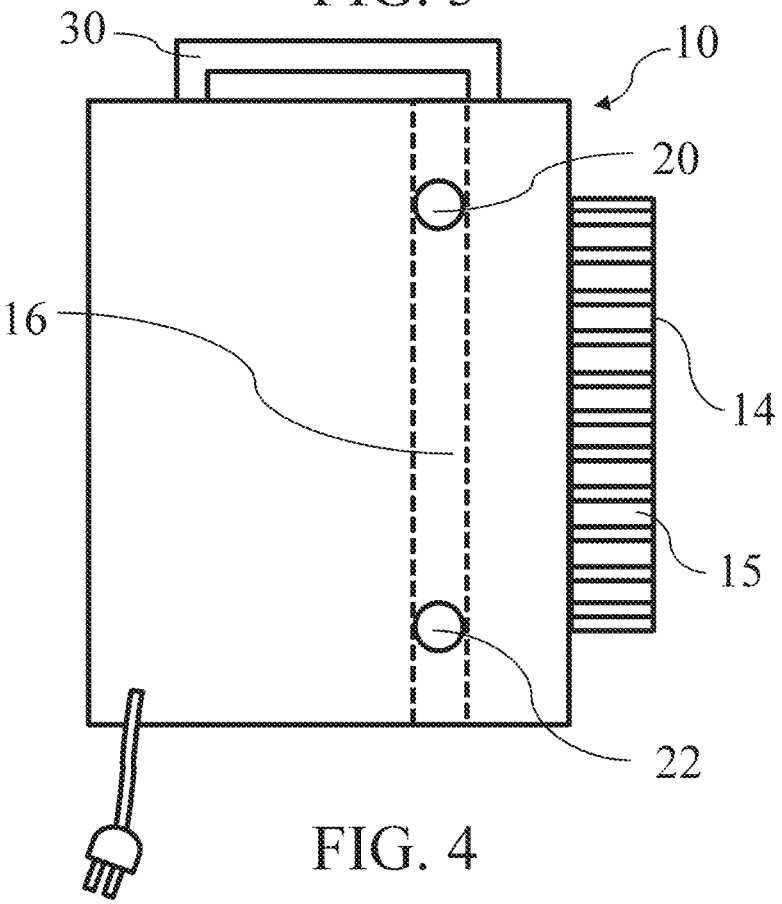
FIG. 4 illustrates a front view of a cooling apparatus in an embodiment of the present invention.
Figure 5:
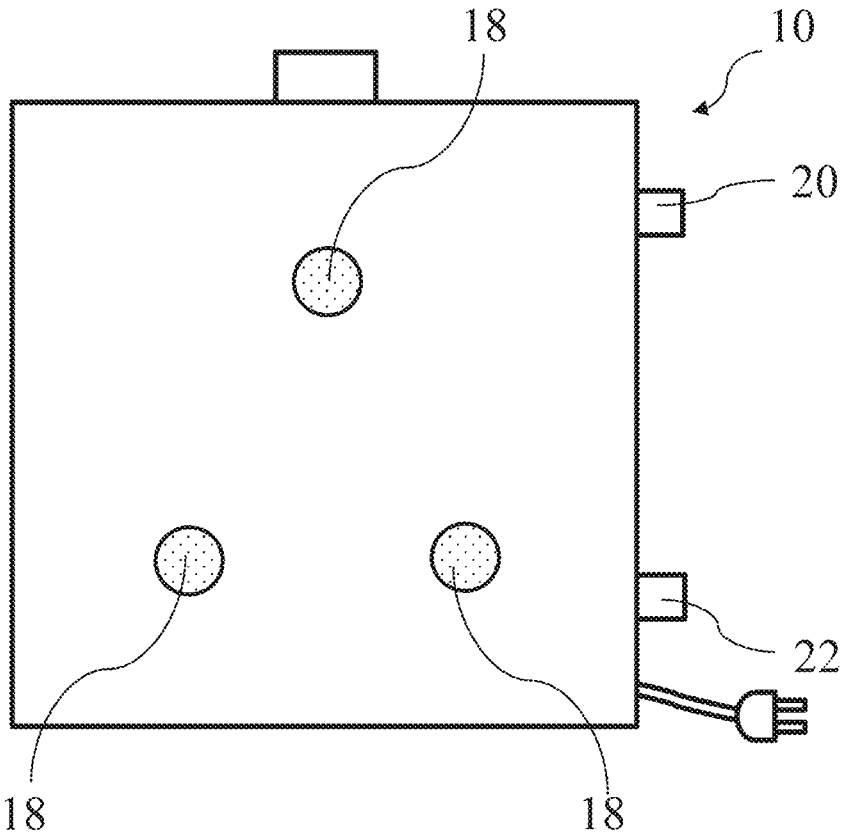
FIG. 5 illustrates an alternate side view of a cooling apparatus in an embodiment of the present invention.

FIG. 3 illustrates a side view of the apparatus 10 of the present invention showing the fan 14 that may be utilized to blow air on the heat plate 17 to cool it. A power cord 29 for powering the fan 14 may further be provided, and may be connected to the ac/dc converter 13, as illustrated in FIGS. 1 and 2-5. Alternatively, the fan 14 may be powered via batteries, or any other power source apparent to one of ordinary skill in the art. FIG. 4 illustrates a front view of the apparatus 10 of the present invention showing the inlet 20 and the outlet 22 of the coil 19. FIG. 5 illustrates an alternate side view of the apparatus 10 of the present invention showing the vent holes 18 for venting heated air from the ac/dc converter 13 or heated air not transferred to the heat plate 17. Also, as illustrated in the drawings, a convenient handle 30 may be provided for easily carrying the apparatus 10.

Figure 6:
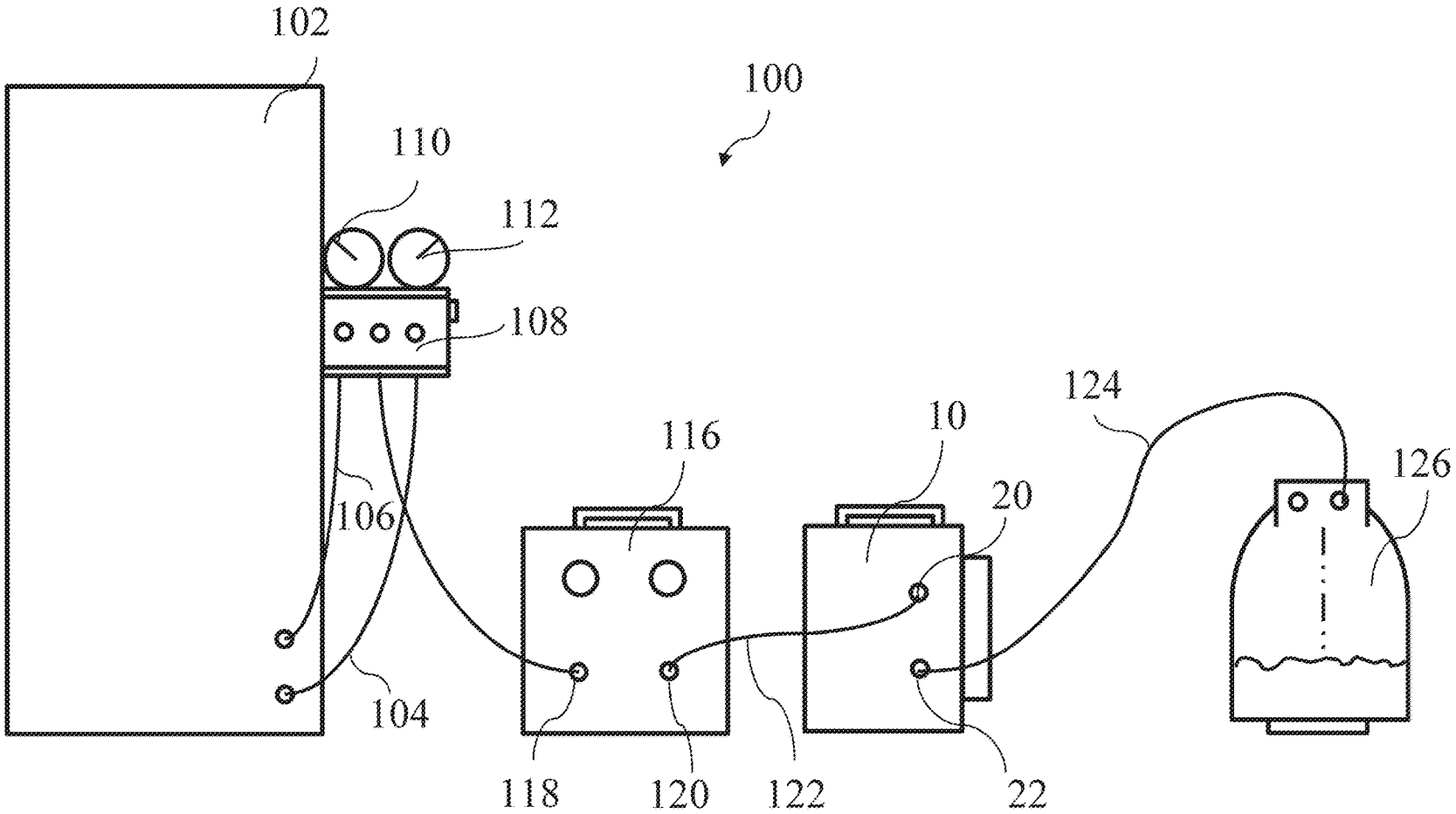
FIG. 6 illustrates a system of cooling and collecting refrigerant in an embodiment of the present invention.

FIG. 6 illustrates a system 100 in an embodiment of the present invention. The system 100 may comprise a refrigeration device 102 having refrigerant therein. The refrigeration device 102 may be an air conditioner, a refrigerator, or any other refrigeration device utilizing refrigerant for cooling. Refrigerant discharge lines 104, 106 may allow refrigerant to be removed from the refrigeration device 102 through manifold 108 having gauges 110, 112 thereon to regulate and monitor the pressure of refrigerant removed from the refrigeration device 102 through the discharge lines 104, 106. An outlet line 114 may extend from the manifold 108 to a refrigerant reclaimer 116, which may provide suction to the refrigeration device 102 to remove refrigerant from the refrigeration device 102. The refrigerant reclaimer 116 may have an inlet 118 and an outlet 120, moving refrigerant therethrough into an apparatus 10 of the present invention. A first refrigerant transfer line 122 may move refrigerant from the outlet 120 of the refrigerant reclaimer 116 to the inlet 20 of the cooling apparatus 10, where refrigerant may flow therethrough and be cooled by the apparatus 10.

The refrigerant may be expelled from the apparatus 10 in a cooled state via the outlet 22 of the apparatus 10 and may be transferred via a second transfer line 124 to a tank 126 which may be utilized for collecting the refrigerant therein. Because the refrigerant is cooled and/or condensed via the apparatus 10, the refrigerant may have less volume per unit than prior to cooling. Thus, the refrigerant may more easily be added to the tank 126. Therefore, the tank 126 may hold more refrigerant, allowing for the collection of refrigerant from the refrigeration device 102 without having to change the tank 126 to ensure that the entirety of the refrigerant is removed from the refrigeration device 102. Thus, it is easier and more efficient to remove refrigerant from the refrigeration device 102 than without cooling the refrigerant, potentially reducing accidental releases of refrigerant, such as the environmentally-damaging R22 Freon.

In an alternate embodiment of the present invention, air may blow across the coil 19 and the first layer 24 and second layer 26 directly from the fan 14 and may exchange heat from the refrigerant to the air blowing thereacross, cooling the refrigerant flowing through the coil 19. Specifically, the heated refrigerant may be cooled as heat from the refrigerant is transferred to the air flowing thereacross.

Figure 7:
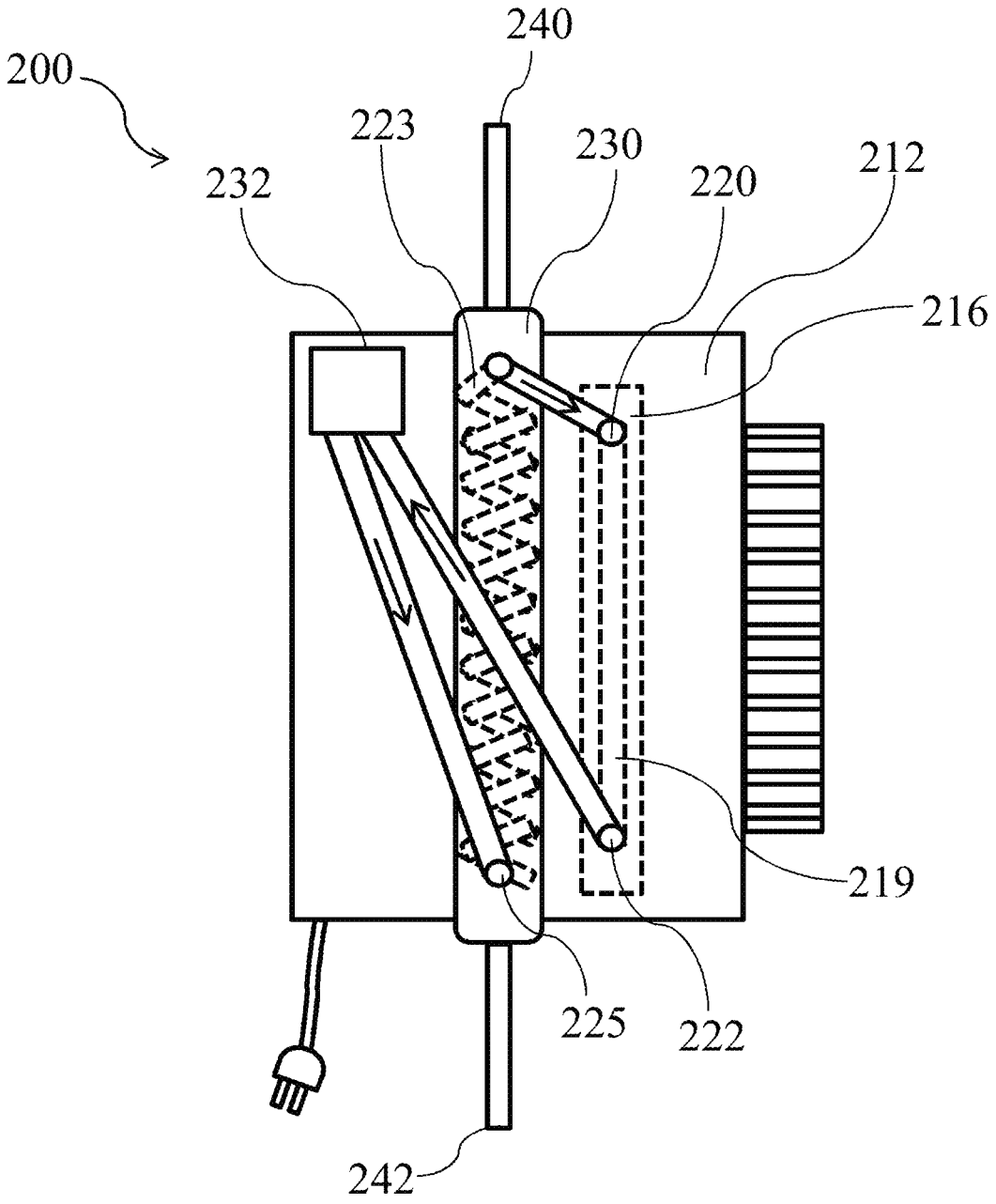
FIG. 7 illustrates a top view of a cooling apparatus in an alternate embodiment of the present invention.
Figure 8:
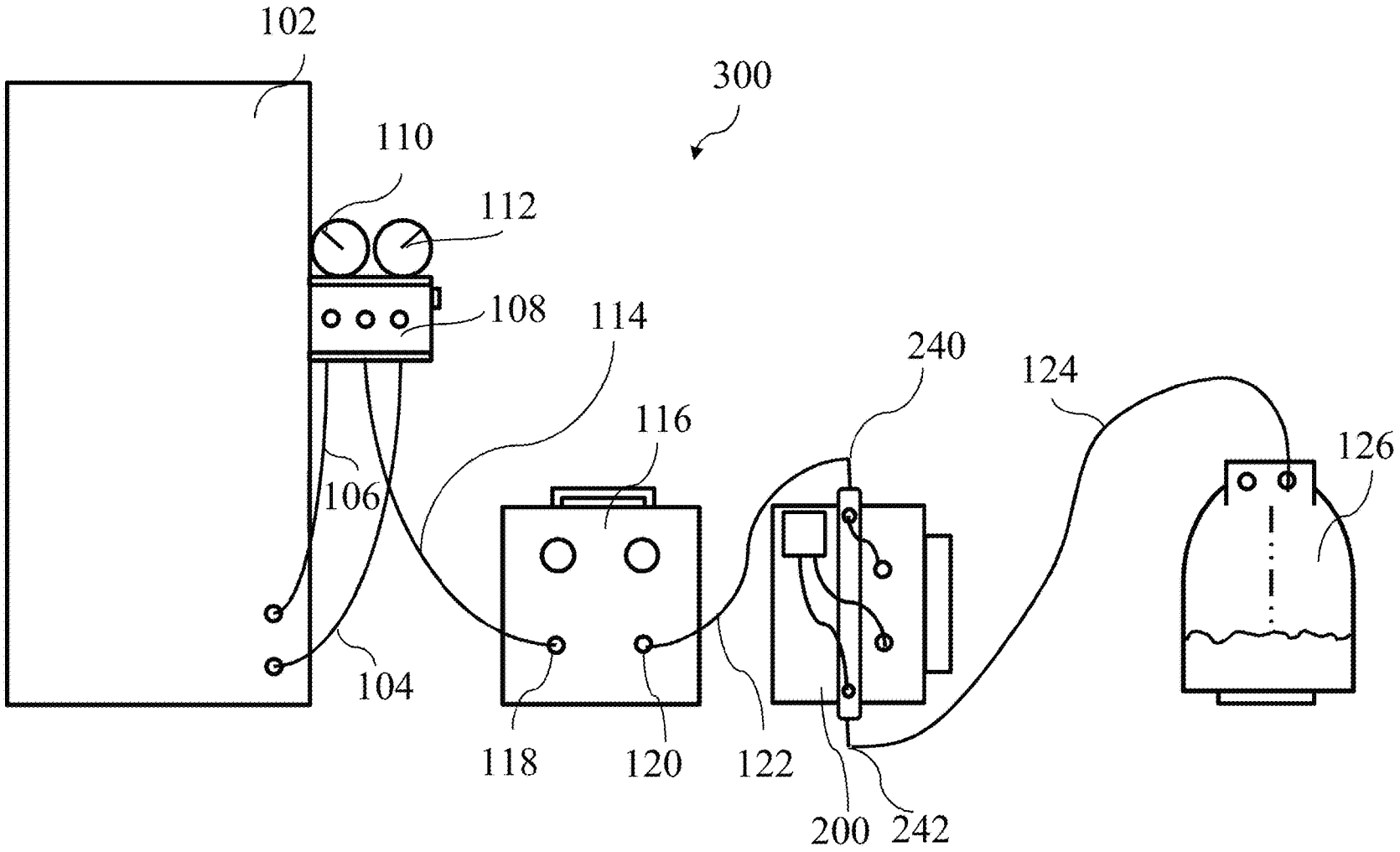
FIG. 8 illustrates a system of cooling and collecting refrigerant in an alternate embodiment of the present invention.
Figure 10:
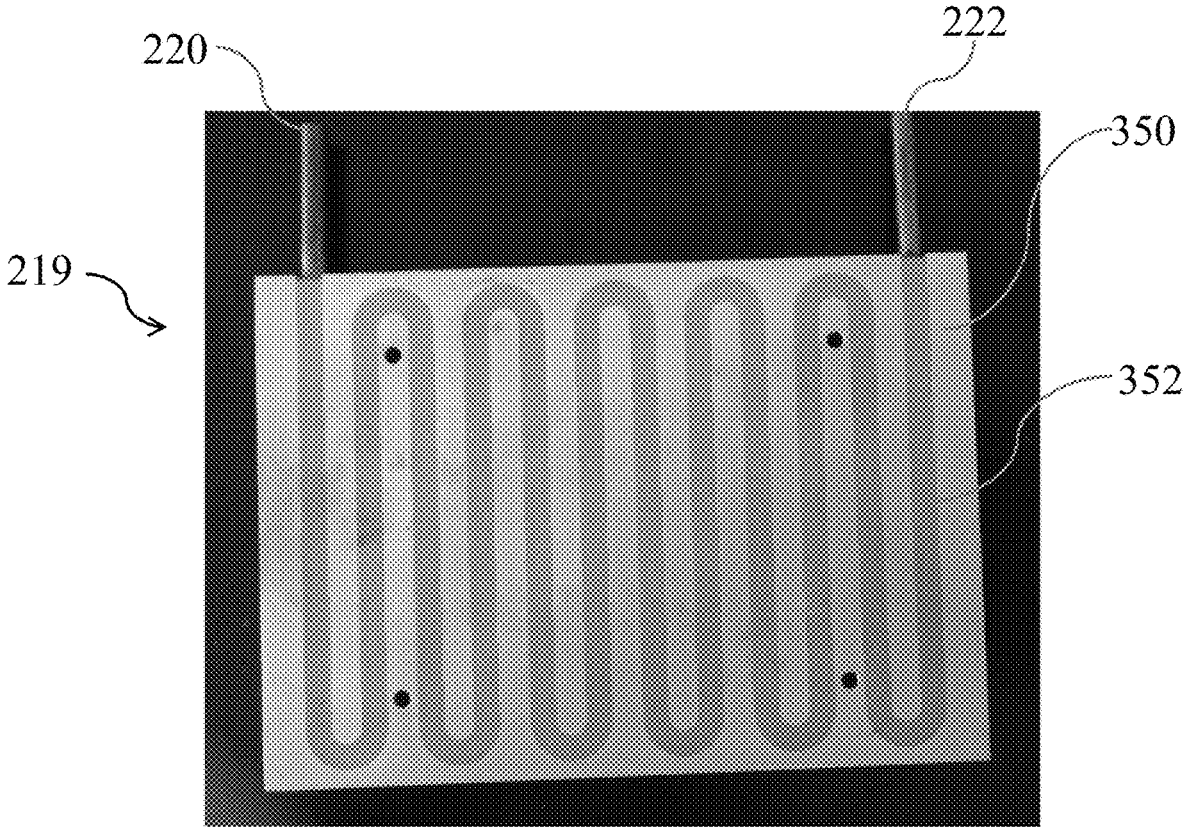
FIG. 10 illustrates a coil within an aluminum block in an embodiment of the present invention.

In yet another alternate embodiment of the present invention, illustrated in FIGS. 7 and 8, a cooling apparatus 200 is provided. The cooling apparatus 200 comprises a housing 212 comprising, internally, one or more cold plates 216 that may surround, sandwich or otherwise adjacently contract a thermally conductive coil 219 that may be disposed therein, similar to the apparatus 10 disclosed above with respect to FIGS. 1-5. A representation of the coil 219 is illustrated in FIG. 10. The coil 219 may have an inlet 220 and an outlet 222 through which a cooling fluid, such as water, for example, may be circulated. The coil 219 may preferably have several passes to maximize the cooling of the cooling water therein. For example, in a preferred embodiment, the coil 219 may have 12 passes through the cold plates 216 for chilling the cooling fluid therein, although the present invention should not be limited as described herein, as any number of passes may be utilized as necessary. Moreover, the coil 219 may comprise a copper tube 352 within an aluminum block 350, as shown in FIG. 10, allowing maximum heat transfer therethrough.

The inlet 220 may receive cooling fluid from a cooling coil 223 disposed within a cooling chamber 230, such as a cylinder, for example. The cooling coil 223 may have an inlet 225 and an outlet 227 through which the cooling fluid may be circulated from a fluid pump 232. The condenser coil 223 may traverse the interior of the cooling cylinder 230 and chill material that may flow therethrough, as provided in further detail below.

Specifically, cooling fluid, such as water, for example, may be pumped through the thermally conductive coil 219 within the housing and may be chilled with the one or more cooling plates contained therein. The cooling plates may be cooled via Peltier cooling as described above with reference to FIGS. 1-5. The chilled cooling fluid may then be pumped via the pump 232 into the condenser coil 223 and traverse through the cooling cylinder 230 to chill material contained within the cooling cylinder 230.

The cooling cylinder 230 may have an inlet 240 and an outlet 242 through which material may flow therethrough and, thus, through the cooling cylinder 230. For example, gaseous material, such as refrigerant, may be inserted through the inlet 240 into the cooling cylinder 230 through which the chilled cooling fluid flows through the condenser coil 223. The gaseous material may thus be chilled and flow out of the outlet 242 to be collected.

FIG. 8 illustrates an exemplary system 300 in an embodiment of the present invention. The system 300 may comprise refrigeration device 102 having refrigerant therein. The refrigeration device 102 may be an air conditioner, a refrigerator, or any other refrigeration device utilizing refrigerant for cooling. Refrigerant discharge lines 104, 106 may allow refrigerant to be removed from the refrigeration device 102 through manifold 108 having gauges 110, 112 thereon to regulate and monitor the pressure of refrigerant removed from the refrigeration device 102 through the discharge lines 104, 106. An outlet line 114 may extend from the manifold 108 to a refrigerant reclaimer 116, which may provide suction to the refrigeration device 102 to remove refrigerant from the refrigeration device 102. The refrigerant reclaimer 116 may have an inlet 118 and an outlet 120, moving refrigerant therethrough into an apparatus 200 of the present invention. A first refrigerant transfer line 122 may move refrigerant from the outlet 120 of the refrigerant reclaimer 116 to the inlet 240 of the cooling apparatus 200, where refrigerant may flow through cooling cylinder 230 and be cooled thereby, as described above with reference to FIG. 7.

The refrigerant may be expelled from the apparatus 200 in a cooled state via the outlet 242 of the apparatus 200 and may be transferred via a second transfer line 124 to a tank 126 which may be utilized for collecting the refrigerant therein. Because the refrigerant is cooled and/or condensed via the apparatus 200, the refrigerant may have less volume per unit than prior to cooling. Thus, the refrigerant may more easily be added to the tank 126. Therefore, the tank 126 may hold more refrigerant, allowing for the collection of refrigerant from the refrigeration device 102 without having to change the tank 126 to ensure that the entirety of the refrigerant is removed from the refrigeration device 102. Thus, it is easier and more efficient to remove refrigerant from the refrigeration device 102 than without cooling the refrigerant, potentially reducing accidental releases of refrigerant, such as the environmentally-damaging R22 Freon.

Figure 9:
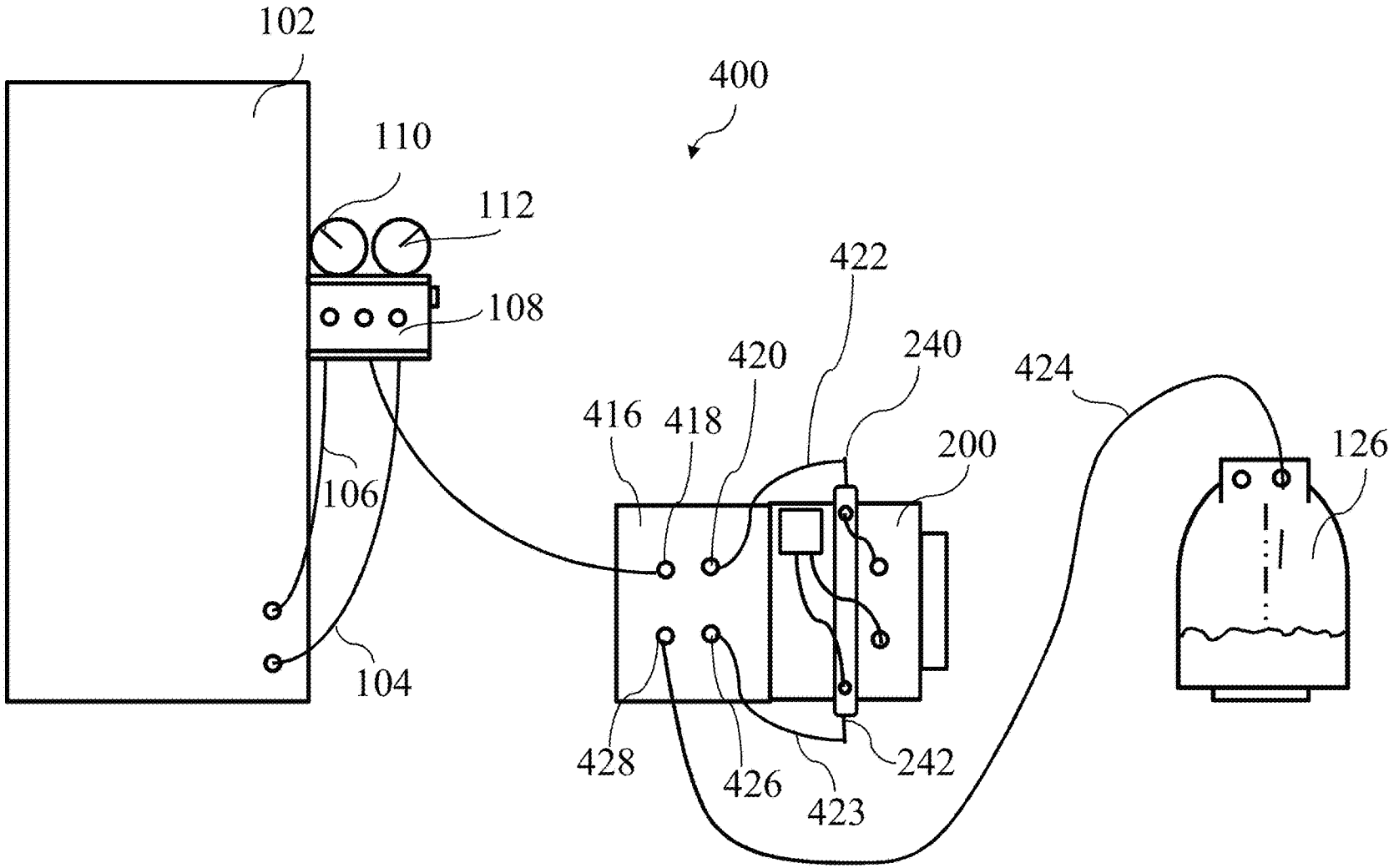
FIG. 9 illustrates a system of cooling and collecting refrigerant in yet another alternate embodiment of the present invention.

FIG. 9 illustrates yet another exemplary system 400 in an embodiment of the present invention. The system 400 may comprise refrigeration device 102 having refrigerant therein. As noted above, the refrigeration device 102 may be an air conditioner, a refrigerator, or any other refrigeration device utilizing refrigerant for cooling. Refrigerant discharge lines 104, 106 may allow refrigerant to be removed from the refrigeration device 102 through manifold 108 having gauges 110, 112 thereon to regulate and monitor the pressure of refrigerant removed from the refrigeration device 102 through the discharge lines 104, 106. An outlet line 114 may extend from the manifold 108 to a refrigerant reclaimer pump 416, which may move refrigerant from the refrigeration device 102. The refrigerant reclaimer pump 416 may have a first inlet 418 and a first outlet 420, moving refrigerant therethrough into an apparatus 200 of the present invention. A first refrigerant transfer line 422 may move refrigerant from the first outlet 420 of the refrigerant reclaimer 416 to the inlet 240 of the cooling apparatus 200, where refrigerant may flow through cooling cylinder 230 and be cooled thereby, as described above with reference to FIG. 7.

The refrigerant may be expelled from the apparatus 200 in a cooled state via the outlet 242 of the apparatus 200 and may be transferred via a second transfer line 423 back to either another pump (not shown) or back to the refrigerant reclaimer pump 416. Second transfer line 423 may move the cooled refrigerant to second inlet 426 of the refrigerant reclaimer pump 416. A third transfer line 424 may move refrigerant from a second outlet 428 of the reclaimer pump 416 to a tank 126 which may be utilized for collecting the refrigerant therein. Thus, the refrigerant reclaimer pump 416 may aid in moving the refrigerant both from the refrigeration device 102 to the cooling apparatus 200 and from the cooling apparatus 200 into the tank 126. The refrigerant reclaimer pump 416 may be integrally attached to the cooling apparatus 200 or may be separate, as apparent to one of ordinary skill in the art.

Because the refrigerant is cooled and/or condensed via the apparatus 200, the refrigerant may have less volume per unit than prior to cooling. Thus, the refrigerant may more easily be added to the tank 126. Therefore, the tank 126 may hold more refrigerant, allowing for the collection of refrigerant from the refrigeration device 102 without having to change the tank 126 to ensure that the entirety of the refrigerant is removed from the refrigeration device 102. Thus, it is easier and more efficient to remove refrigerant from the refrigeration device 102 than without cooling the refrigerant, potentially reducing accidental releases of refrigerant, such as the environmentally-damaging R22 Freon.

Other material may be chilled according to the methodology described herein. For example, fluids may flow through the cooling cylinder 230 to be chilled. For example, fluids such as wine may be chilled according to the present invention. Specifically, the wine or other fluid may be pumped through cooling cylinder 230 and chilled via heat exchange with the condenser coil 223 contained therein, having the cooling fluid circulating therethrough, as described above.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An apparatus for cooling a material, the apparatus comprising:

a thermoelectric cooler comprising a cold plate, a heat plate and a thermoelectric material between the cold plate and the heat plate for cooling the cold plate and heating the heat plate when voltage is applied across the thermoelectric material;

a first cooling coil adjacent the cold plate;

a cooling chamber having a first inlet and a first outlet and a second cooling coil disposed between the first inlet and the first outlet, wherein a cooling fluid is sent through the first cooling coil to be cooled by the cold plate and thereafter to the second cooling coil within the cooling chamber, wherein the cooling chamber further comprises a second inlet and a second outlet, and configured to allow a material to be cooled to traverse through the second inlet, the chamber and the second outlet to be chilled by the second coiling coil, wherein the material is wine.

2. The apparatus of claim 1 further comprising:

a pump for circulating the cooling fluid through the first cooling coil and the second cooling coil.

3. The apparatus of claim 1 further comprising:

a fan disposed adjacent the hot plate for cooling the hot plate.

4. The apparatus of claim 3 wherein the fan is disposed within a vented housing, and further wherein an airflow is pulled in the vented housing by the fan, propelled towards the heat plate, and subsequently pushed out of the vented housing.

5. The apparatus of claim 1 further comprising:

a pump; and a first transfer tube from the pump to the first inlet of the cooling chamber, wherein the pump is configured to move the cooling fluid into the cooling chamber through the first inlet.

6. The apparatus of claim 5 further comprising:

a second transfer tube from the first outlet of the cooling chamber to the pump, wherein the pump is further configured to move the cooling fluid out of the cooling chamber through the first outlet.

7. A system for cooling a material comprising:

a cooling apparatus comprising a thermoelectric cooler comprising a cold plate, a heat plate and a thermoelectric material between the cold plate and the heat plate for cooling the cold plate and heating the heat plate when voltage is applied across the thermoelectric material; a first cooling coil adjacent the cold plate; a cooling chamber having a first inlet and a first outlet and a second cooling coil disposed between the first inlet and the first outlet and a second inlet and a second outlet; a cooling fluid circulating through the first cooling coil and cooled by the cold plate, the cooling fluid thereafter circulated to the second cooling coil within the cooling chamber;

a material within the cooling chamber chilled by the cooling fluid circulating within the second cooling coil;

a refrigeration unit having refrigerant therein, the refrigeration unit comprising an outlet configured to send the refrigerant to the second inlet in the cooling chamber to form chilled refrigerant within the cooling chamber;

a collection tank comprising an inlet configured to receive the chilled refrigerant from the second outlet of the cooling chamber;

a refrigerant reclaimer pump;

a first transfer tube running from the refrigeration unit to the refrigerant reclaimer pump;

a second transfer tube running from the refrigerant reclaimer pump to the second inlet of the cooling chamber, wherein the refrigerant reclaimer pump is configured to move the refrigerant from the refrigeration unit to the second inlet of the cooling chamber through the first transfer tube and the second transfer tube;

a third transfer tube running from the second outlet of the cooling chamber to the refrigerant reclaimer pump; and a fourth transfer tube running from the refrigerant reclaimer pump to the inlet of the collection tank, wherein the refrigerant reclaimer pump is configured to move the refrigerant from the second outlet of the cooling chamber to the collection tank through the third and fourth transfer tubes.

8. The system of claim 7 further comprising:

a pump configured to circulate the cooling fluid through the first cooling coil and the second cooling coil.

9. A method of cooling a material comprising the steps of:

providing a cooling apparatus comprising a thermoelectric cooler comprising a cold plate, a heat plate and a thermoelectric material between the cold plate and the heat plate for cooling the cold plate and heating the heat plate when voltage is applied across the thermoelectric material; a first cooling coil adjacent the cold plate; a cooling chamber having a first inlet and a first outlet and a second cooling coil disposed between the first inlet and the first outlet and a second inlet and a second outlet;

moving a cooling fluid through the first cooling coil and cooled by the cold plate;

moving the cooling fluid from the first cooling coil to the second cooling coil within the cooling chamber;

disposing wine within the cooling chamber;

chilling the wine within the cooling chamber via heat exchange with the cooling fluid moving within the second cooling coil; and moving the wine out of the cooling chamber.

10. The method of claim 9 wherein the cooling fluid moves through the first cooling coil and the second cooling coil via a pump.

11. The method of claim 9 wherein the cooling fluid is circulating from the second cooling coil back to the first cooling coil via a recirculation pump.

* * * * *